United States Patent [19]

Newman

[11] Patent Number: 4,615,120

[45] Date of Patent: Oct. 7, 1986

[54] COLLAPSIBLE SPOON

[75] Inventor: Brett E. Newman, Weston, Conn.

[73] Assignee: Continental Can Company, Inc., Stamford, Conn.

[21] Appl. No.: 685,103

[22] Filed: Dec. 21, 1984

[51] Int. Cl.[4] ..... A47J 43/28

[52] U.S. Cl. ..... 30/324; 30/143; 16/227

[58] Field of Search ..... 30/143, 147, 324; 16/115, 225, 227

[56] References Cited

U.S. PATENT DOCUMENTS

| | | | |
|---|---|---|---|
| 588,174 | 8/1897 | Praunegger | 30/143 |
| 780,781 | 1/1905 | Curtis | 30/324 |
| 1,288,617 | 12/1918 | Kupiszewski | 30/147 X |
| 1,321,670 | 11/1919 | Popper | 30/143 |
| 1,488,463 | 4/1924 | Abram | 30/147 |
| 2,457,037 | 12/1948 | Fadeley | 30/324 X |
| 2,812,577 | 11/1957 | Leibow | 30/324 |
| 3,618,161 | 11/1971 | Nozawa | 16/227 |
| 4,158,902 | 6/1979 | Chernack | 16/227 |
| 4,403,712 | 9/1983 | Wiesinger | 16/227 |

*Primary Examiner*—Jimmy C. Peters

*Attorney, Agent, or Firm*—Charles E. Brown

[57] ABSTRACT

This relates to a utensil such as a spoon which is collapsible to occupy a minimum of space. The utensil preferably has a handle formed in two parts joined together by a hinge with there being a releasable interlock between the two handle parts adjacent the hinge for maintaining the handle parts in longitudinal alignment and as an extension of one another. The handle parts may also be provided with cooperating interlocking structure for maintaining the handle parts in longitudinally aligned overlapping relation when the utensil is collapsed. This abstract is not to be constructed as limiting the claims of the application.

13 Claims, 6 Drawing Figures

COLLAPSIBLE SPOON

This invention relates in general to new and useful improvements in utensils which may be readily collapsed to occupy a minimum of space and at the same time so erectible as to be rigid and of normally adequate strength. Most particularly, the invention relates to a spoon having a collapsible or foldable handle which may be folded upon itself to reduce the overall length of the spoon to one-half of its operative length and wherein there is associated with an integral hinge cooperating interlocking mechanism adjacent the hinge for releasably retaining the handle parts as a rigid extension of one another.

The invention particularly relates to a utensil which is readily adaptable to forming by injection molding of a suitable plastic material.

With the above and other objects in view that will hereinafter appear, the nature of the invention will be more clearly understood by reference to the following detailed description, the appended claims, and the several views illustrated in the accompanying drawings.

Figure 1:
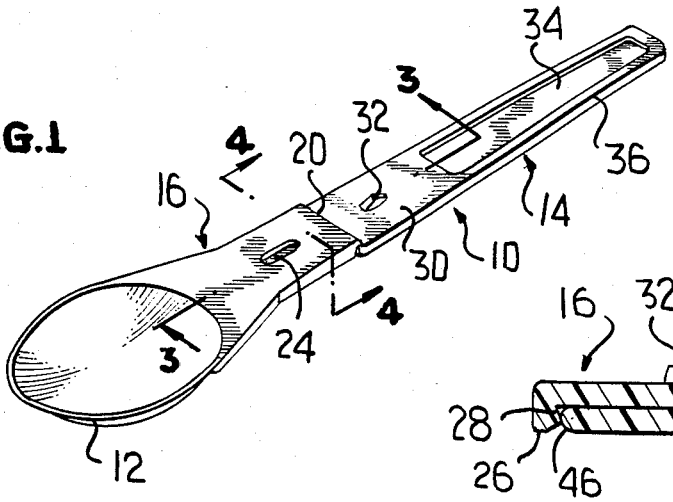
FIG. 1 is a top perspective view of a spoon formed in accordance with this invention.

Referring now to the drawings in detail, it will be seen that there is illustrated in FIG. 1 a utensil which is formed in accordance with this invention, the utensil being generally identified by the numeral 10 and being in the form of a spoon. The utensil or spoon 10 includes a bowl 12 having an integral handle 14. The handle 14 is formed in two parts, handle part 16 with which the bowl 12 is integral, and handle part 18 which is remote from the bowl 12 and is connected to the handle part 16 by way of an integral transverse hinge 20 defined by a strap 22.

Figure 5:
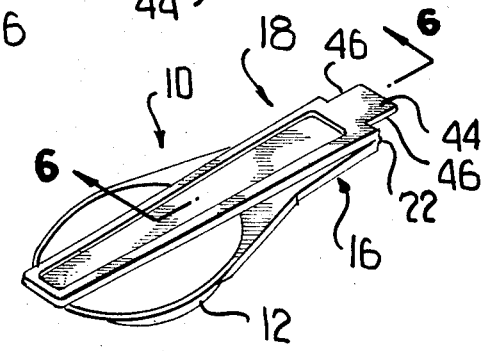
FIG. 5 is a top perspective view similar to FIG. 1, and shows the spoon in its collapsed state.

As is clearly shown in FIG. 5, the spoon 10 is collapsible in that the handle part 18 may fold into overlying relation with respect to the handle part 16 and the bowl 12 so that the spoon 10 may collapse. The spoon 10 as illustrated in FIG. 5 is relatively small and may be attached to a very small package for the purpose of dispensing a product which is packed in such small package.

It is known to provide utensils including spoons with handles which are collapsible by folding. However, such handles, when extended, do not have the structural strength of a solid handle. In accordance with this invention, every effort is made to provide a releasable interlock between the handle parts 16 and 18 which will make the handle 14 rigid to substantially the same extent as though the handle were formed without the hinge 20.

Figure 2:
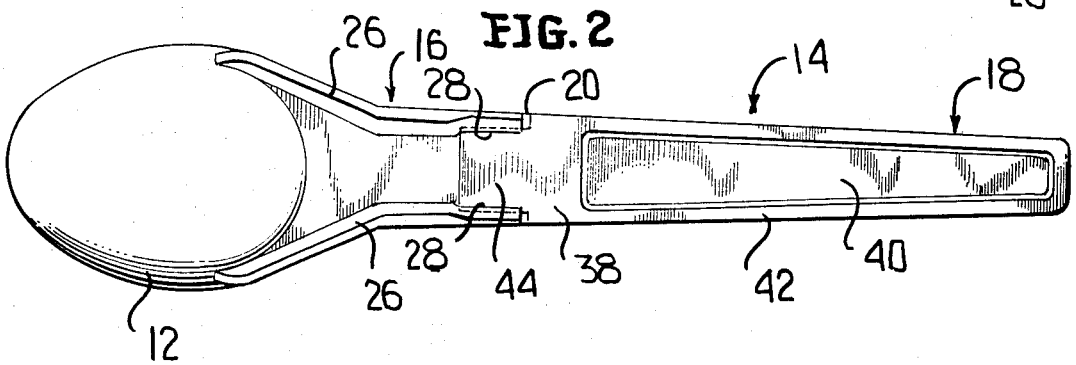
FIG. 2 is an enlarged bottom plan view of the spoon of FIG. 1, and shows the details of cooperating interlocking means on the two handle parts.

As is best shown in FIG. 1, the handle part 16 is provided along the longitudinal center line thereof and spaced from the hinge 20 with a longitudinally extending recess 24. Also, as is best shown in FIG. 2, the handle part 16 is reinforced by a longitudinally extending stiffening rib 26 which extends along opposite edges thereof. The stiffening ribs 26 at one end thereof merge into the bowl 12 and at the opposite and thereof terminate immediately adjacent the hinge 20. The stiffening ribs 26 adjacent the hinge 20 have opposed undercut portions 28.

The handle part 18 on the upper surface thereof has a planar part 30 adjacent the hinge 20 with the planar part 30 carrying an upstanding longitudinally extending rib 32.

The upper surface of the handle part 18 remote from the bowl 12 is recessed as at 34 to define a stiffening rib arrangement 36.

As is clearly shown in FIG. 2, the underside of the handle part 18 adjacent the hinge 20 is also planar and identified by the numeral 38. Remote from the bowl 12 the underside of the handle part 18 is recessed as at 40 to define a peripheral stiffening rib arrangement 42.

Figure 6:
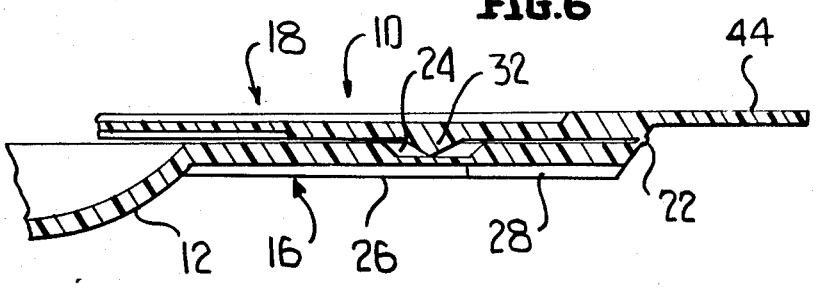
FIG. 6 is an enlarged fragmentary longitudinal vertical sectional view taken generally along the line 6—6 of FIG. 5, and shows the interlock between the handle parts which the spoon is collapsed for maintaining the handle parts in longitudinal alignment.

As is best shown in FIGS. 5 and 6, the handle part 18 has formed integrally with the underpart thereof a generally rectangular tongue 44 which projects beyond the hinge strap 22.

Figure 4:
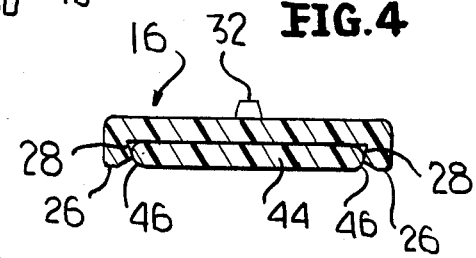
FIG. 4 is an enlarged transverse vertical sectional view taken generally along the line 4—4 of FIG. 1, and shows the manner in which a tongue carried by one of the handle parts interlocks in a socket of the other of the handle parts.
Figure 3:
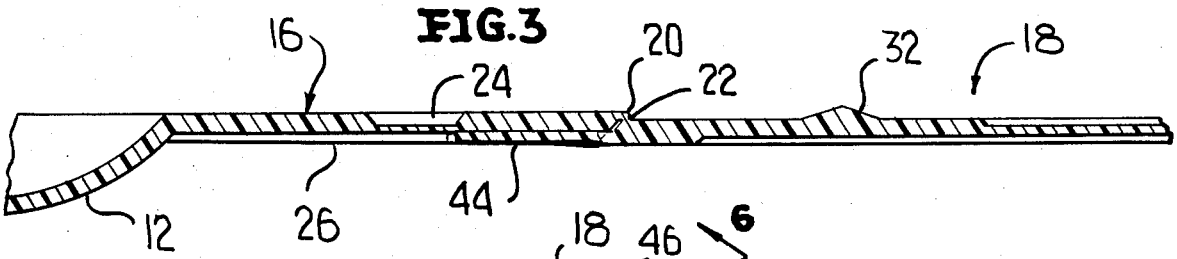
FIG. 3 is an enlarged fragmentary longitudinal vertical sectional view taken generally along the line 3—3 of FIG. 1, and shows further the structural details of the handle parts.

The tongue 44, when the handle parts 16, 18 are generally planar and form extensions of one another, are seated in the socket defined by the undercut 28, as is clearly shown in FIGS. 2, 3 and 4. Due to the undercuts 28, which are best shown in FIG. 4, once the tongue 44 has snapped into the socket, remote edges of the tongue 44 are engaged behind the undercuts and tightly join the handle part 18 to the handle part 16 to provide an erected or an extended handle 14 which is rigid in the direction of use. Furthermore, the tongue 44 is provided with rounded edges 46 which function as cam means to facilitate the snapping of the tongue 44 beneath the undercuts.

As previously described, the rib 32 and the recess 24 cooperate when the handle part 18 is folded into overlying relation with respect to the handle part 16 as shown in FIG. 5. The rib or projection 32 enters into the recess 24 (FIG. 6) and interlocks with the handle parts 16 and 18 against transverse movement relative to one another which would place an undue pressure on the hinge strap 22.

Although the particular utensil 10 has been illustrated as a spoon, it is to be understood that other utensil shapes may incorporate the collapsible handle construction herein described.

It will be readily apparent from the foregoing that when one collapses the handle part 18 and forces the bowl or the equivalent part of the utensil 10 against the product in a lifting or prying manner, the tendency of the handle part 18 to pivot about the hinge 20 results in the tongue 44 engaging the underside of the handle part 16 in a rigid beam-like manner. Thus, the interlock between the tongue 44 and the handle part 16 need overcome only the tendency of the handle parts to collapse relative to one another when the utensil is not being utilized.

Although only a preferred embodiment of the utensil and collapsible handle construction has been pecifically illustrated and described herein, it is to be understood that minor variations may be made in the utensil without departing from the spirit and scope of the invention as defined by the appended claims.

What is claimed is:

1. A utensil comprising a product handling part and a one-piece handle, said handle having an intermediate transverse bendable hinge dividing said handle into two parts and forming means for facilitating folding of said handle back upon itself to a stored position, and cooperating interlocking means on said handle parts adjacent said hinge for releasably retaining said handle parts as rigid extensions of one another, said cooperating interlocking means being disposed entirely to one side of said hinge.

2. A utensil according to claim 1 wherein said handle parts having interlocking means for retaining said handle parts in alignment when said handle is folded back on itself.

3. A utensil according to claim 1 wherein said utensil is of a one-piece injection molded plastic construction.

4. A utensil according to claim 1 wherein said utensil is a spoon.

5. A utensil comprising a product handling part and a one-piece handle, said handle having an intermediate transverse bendable hinge dividing said handle into two parts and forming means for facilitating folding of said handle back upon itself to a stored position, and cooperating interlocking means on said handle parts adjacent said hinge for releasably retaining said handle parts as rigid extensions of one another, said cooperating interlocking means including a tongue carried by one of said handle parts and a socket carried by the other of said handle parts, and there being a snap interlock between said tongue and said socket.

6. A utensil according to claim 5 wherein said cooperating interlocking means are disposed entirely to one side of said hinge.

7. A utensil according to claim 5 wherein said cooperating interlocking means are disposed entirely to one side of said hinge, said tongue extending across said hinge longitudinally of said handle.

8. A utensil according to claim 5 wherein said handle has an underside and said cooperating interlocking means are formed on said handle underside whereby a normal bending force placed on said handle in the use of said utensil more tightly forces said tongue into said socket.

9. A utensil according to claim 5 wherein said utensil is of a one-piece injection molded plastic construction.

10. A utensil according to claim 5 wherein said utensil is a spoon.

11. A utensil comprising a product handling part and a handle, said handle having an intermediate transverse hinge dividing said handle into two parts and forming means for facilitating folding of said handle back upon itself, and cooperating interlocking means on said handle parts adjacent said hinge for releasably retaining said handle parts as rigid extensions of one another, said cooperating interlocking means including a tongue carried by one of said handle parts and a socket carried by the other of said handle parts, and there being a snap interlock between said tongue and said socket, said handle having longitudinal stiffening ribs along side edges of at least said other handle parts, and portions of said ribs forming portions of said socket.

12. A utensil according to claim 11 wherein said rib portions are undercut in opposed relation, and remote side edges of said tongue are engaged in said undercuts.

13. A utensil according to claim 12 wherein said tongue side edges are rounded and form cam means.

* * * * *